US010494244B2

(12) United States Patent
Müller-Brockhausen et al.

(10) Patent No.: US 10,494,244 B2
(45) Date of Patent: Dec. 3, 2019

(54) DEVICE FOR INTRODUCING A MEDIUM INTO A CONTAINER

(71) Applicant: INDAG POUCH PARTNERS GMBH, Eppelheim (DE)

(72) Inventors: Mansur Müller-Brockhausen, Edingen-Neckarhausen (DE); Frank Lechert, Weinheim (DE)

( * ) Notice: Subject to any disclaimer, the term of this patent is extended or adjusted under 35 U.S.C. 154(b) by 73 days.

(21) Appl. No.: 15/523,088

(22) PCT Filed: Oct. 27, 2015

(86) PCT No.: PCT/EP2015/074804
§ 371 (c)(1),
(2) Date: Apr. 28, 2017

(87) PCT Pub. No.: WO2016/066609
PCT Pub. Date: May 6, 2016

(65) Prior Publication Data

US 2018/0237279 A1 Aug. 23, 2018

(30) Foreign Application Priority Data

Oct. 29, 2014 (EP) ..... 14190837

(51) Int. Cl.
*B67C 3/26* (2006.01)
*B65B 39/12* (2006.01)
(Continued)

(52) U.S. Cl.
CPC ..... *B67C 3/26* (2013.01); *B65B 39/12* (2013.01); *B65B 39/145* (2013.01); *B65B 55/10* (2013.01);
(Continued)

(58) Field of Classification Search
CPC ..... B67C 3/26; B67C 2003/2654; B67C 2003/228; B65B 55/10; B65B 39/12; B65B 39/145
See application file for complete search history.

(56) References Cited

U.S. PATENT DOCUMENTS 6,179,016 B1 1/2001 Neacker et al.
7,104,033 B2 * 9/2006 Krulitsch ..... B67C 3/004 141/91
(Continued)

FOREIGN PATENT DOCUMENTS

DE 19855975 C1 3/2000
DE 102005003222 A 7/2006
(Continued)

OTHER PUBLICATIONS

EP14190837.6; European Search Report; dated Apr. 28, 2015, pp. 1-6.
(Continued)

*Primary Examiner* — Timothy L Maust
(74) *Attorney, Agent, or Firm* — Mayer Brown LLP

(57) ABSTRACT

The invention relates to an apparatus and a method for passing a medium into a container, for example a flexible pouch, with a rotatable carousel and one or more treatment stations with a movable lance that can be inserted into the container, and a receptacle for a container, characterized in that an indirect magnetic drive means for moving the lance is provided, wherein a first part (lance part) of the magnetic drive means is joined with the lance and a second part (drive part) of the magnetic drive means is indirectly magnetically coupled with the lance part.

19 Claims, 8 Drawing Sheets

(51) Int. Cl.

| | |
|---|---|
| ***B65B 39/14*** | (2006.01) |
| ***B65B 55/10*** | (2006.01) |
| *B67C 3/22* | (2006.01) |

(52) U.S. Cl.
CPC ..... *B67C 2003/228* (2013.01); *B67C 2003/2654* (2013.01)

(56) References Cited

U.S. PATENT DOCUMENTS

| | | | |
|---|---|---|---|
| 8,434,529 | B2 | 5/2013 | Goldbrunner |
| 2010/0307639 | A1 | 12/2010 | Goldbrunner |

FOREIGN PATENT DOCUMENTS

| | | | |
|---|---|---|---|
| DE | 102005003222 | A1 | 7/2006 |
| DE | 102005031319 | A1 | 1/2007 |
| DE | 102007035872 | A1 | 2/2009 |
| EP | 2221272 | A2 | 8/2010 |
| JP | 2000185796 | A2 | 7/2000 |
| JP | 2003325645 | A2 | 11/2003 |
| JP | 2010030645 | A2 | 2/2010 |

OTHER PUBLICATIONS

Translation of the Office Action dated Feb. 26, 2019 received in Ukrainian Patent Application No. a 2017 04801 (4 pages).

* cited by examiner

DEVICE FOR INTRODUCING A MEDIUM INTO A CONTAINER

RELATED APPLICATIONS

This application is a national stage entry of International Patent Application No. PCT/EP2015/074804, filed Oct. 27, 2015, which claims priority to European Patent Application No. 14190837.6, filed Oct. 29, 2014, each of which is incorporated by reference herein in its entirety.

BACKGROUND

Apparatuses for passing a medium into a container are especially known in the beverage processing industry.

In order to achieve this, usually machines are used that, for example, are embodied as rotary machines and that can comprise a carousel in which the not yet filled containers are introduced into a filling station and are filled in the same. For this purpose, filling vents are positioned either over the container or moved into the same. A filling of the containers with the medium is made through these filling vents. The medium is, for example, the product to be filled into the container.

When filling the product, specific requirements are provided for the cleanliness around and in the opening of the container that can only be fulfilled with high effort.

SUMMARY

The present invention provides, in various embodiments, an apparatus and a method for passing a medium into a container via a movable lance.

In some embodiments, the invention provides an apparatus for passing a medium into a container, comprising a rotatable carousel and one or more treatment stations with a movable lance that can be inserted into the container, wherein an indirect magnetic drive means for moving the lance is provided, wherein a lance part of the magnetic drive means is joined with the lance and a drive part of the magnetic drive means is indirectly magnetically coupled with the lance part.

In some embodiments, the container comprises a flexible pouch.

In some embodiments, the lance and the lance part are arranged in a tube and are movable along the longitudinal axis of the tube, and the drive part is arranged outside the tube and is movable along the longitudinal axis of the tube.

In some embodiments, the drive part is connected with a drive by which the drive part can be moved along the tube.

In some embodiments, the drive comprises an arm that is movably connected with the drive part, wherein the arm is arranged movably along a control cam via a cam roll and movement of the cam roll along the control cam is transferred into a movement of the drive part along the tube.

In some embodiments, the control cam is arranged stationary with respect to the carousel.

In some embodiments, the arm is connected with a spring element that holds the arm in an initial position by tension.

In some embodiments, the drive part comprises a magnet engaging the lance part.

In some embodiments, the lance part is arranged at one end of the lance and a nozzle is arranged at the other end of the lance, wherein the medium can be led from a reservoir through the lance to the nozzle.

In some embodiments, the medium is a sterilizing gas or a product that is to be filled into the container.

In some embodiments, the control cam encloses the axis of rotation of the carousel and a shape of the control cam is continuous.

In some embodiments, the magnetic drive means comprises a linear drive or a servo drive.

In some embodiments, the lance is rotated by means of the magnetic drive means.

In some embodiments, the lance part is mounted in a guide arranged in the tube, wherein the guide is adapted to cause a rotation of the lance part relative to the tube while the lance part is moved along the longitudinal axis of the tube.

In some embodiments, the lance part is mounted in the guide by means of a lubricant-free bearing.

In some embodiments, the bearing is a four-point ball bearing.

In some embodiments, the invention provides a method for passing a medium into a container, comprising passing the medium into the container via a lance, wherein the lance is indirectly magnetically moved into the container in order to introduce the medium.

In some embodiments, a sterilizing gas or a product is passed into the container via the lance.

In some embodiments, the lance is moved along a longitudinal axis of a tube and introduced into the container for passing the medium and, subsequently, is pulled out.

In some embodiments, the lance is rotated while moving into the container and out of the container.

Additional features and advantages of the present invention are described further below. This summary section is meant merely to illustrate certain features of the invention, and is not meant to limit the scope of the invention in any way. The failure to discuss a specific feature or embodiment of the invention, or the inclusion of one or more features in this summary section, should not be construed to limit the invention as claimed.

BRIEF DESCRIPTION OF THE DRAWINGS

The foregoing summary, as well as the following detailed description of the preferred embodiments of the application, will be better understood when read in conjunction with the appended drawings. For the purposes of illustrating the systems and methods of the present application, there are shown in the drawings preferred embodiments. It should be understood, however, that the application is not limited to the precise arrangements and instrumentalities shown. In the drawings.

DETAILED DESCRIPTION

Figure 1:
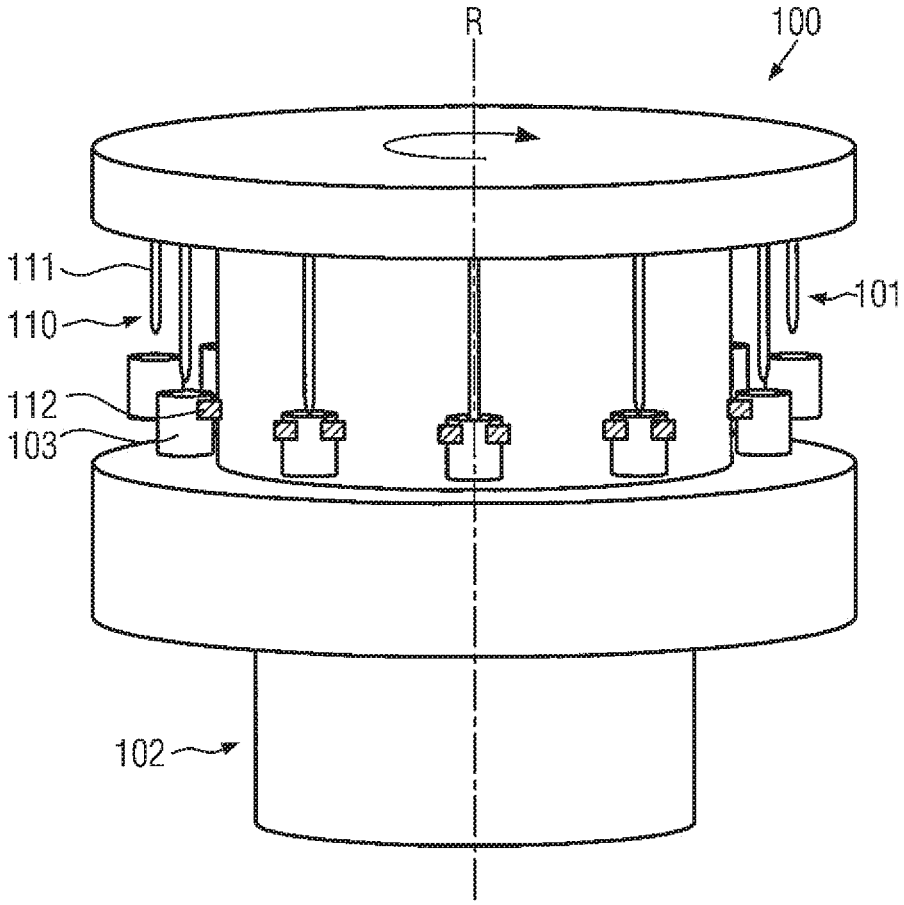
FIG. 1 is a schematic depiction of an apparatus according to the invention.

Starting from the prior art, it is an object of the invention to provide an apparatus for passing a medium into a container that allows for a passing of the medium into a container in a preferably contamination-free manner.

This object is solved according to the invention by the apparatus and the method described below. Various advantageous embodiments of the invention are disclosed.

The apparatus for passing a medium into a container, for example, a flexible pouch, according to the invention is characterized in that an indirect magnetic drive means for moving the lance is provided, wherein a first part (lance part) of the magnetic drive means is joined with the lance and a second part (drive part) of the magnetic drive means is indirectly magnetically coupled with the lance part. Here, according to the invention, the term "indirect magnetic drive means" is to be understood as a drive means for which only the drive part is driven or actively moved and this movement is transmitted to the lance part due to magnetic or electromagnetic interaction of the drive part with a lance part. Therein, it is provided that the lance part and the drive part are separated spatially from another and, in particular, no contact of these parts occurs such that the transmission of the movement of the drive part to the lance part is exclusively made by the magnetic or electromagnetic interaction of those parts among each other.

The apparatus according to the invention allows in particular for a passing of a medium (in particular a gaseous medium for sterilizing) in an area separated from the environment since the movement of the lance part can also be made without a mechanical connection with the drive part. By this, particular conditions with respect to the asepsis or sterility or cleanliness in the area of the opening of the container can be realized. Furthermore, the use of lubricant in the area of the lance can be foregone.

In one embodiment, the lance and the lance part are arranged in a tube and are moveable along the longitudinal axis of the tube and the drive part is arranged outside the tube and moveable along the longitudinal axis of the tube. This tube can enclose the opening of the container and can thus create a surrounding area in which the medium is passed into the container that is at least partially isolated from the environment.

In a further development of this embodiment, the apparatus is characterized in that the drive part is connected with a drive, wherein the drive part is moved along the tube by means of the drive. The movement of the drive part can thus be translated into a movement of the lance part together with a lance inside the tube.

Furthermore, it can be provided that the drive comprises an arm moveably connected with the drive part, wherein the arm is moveably arranged along a control cam via a cam roll and the movement of the cam roll along the control cam is translated into a movement of the drive part along the tube. This embodiment is particularly maintenance-free and works without additional drive motors such that malfunctions can be avoided.

In an advantageous further development, the apparatus is characterized in that the control cam is stationary arranged at the carousel. The rotational movement of the carousel relative to the guide can thus be translated into a movement of the arm such that control units for the movement of single arms of the treatment stations can be omitted.

In a further embodiment, the arm is connected with a spring element that pretentions the arm in an initial position. By this, for example the resetting of the arm into the initial position can be made easier.

In one embodiment of the apparatus according to the invention, the drive part is embodied as a magnet encompassing the lance part. This embodiment allows an indirect drive of the lance part independent of how the lance part is oriented, in particular twisted relative to the drive part.

It is advantageous if the lance part is arranged at one end of the lance and a nozzle is arranged at the other end of the lance, wherein the medium is led from a reservoir through the lance to the nozzle. Contaminations of the lance part due to in particular a fluid medium leaking out from the nozzle can thus be prevented.

Furthermore, it can be provided that the medium is a sterilizing gas and/or the medium is the product to be filed into the container. The invention can thus be applied to the cleaning of the container and the filling of the container.

In a further development of the previous embodiment, the control cam encompasses the rotational axis of the carousel and the shape of the guide is continuous.

According to a further embodiment of the apparatus, it is provided that the drive means comprises a linear drive or a servo drive. This alternative embodiment allows for a selective control of the movement of the drive part of the magnetic drive means in each treatment station.

In an advantageous embodiment, the invention is characterized in that the lance can be rotated by means of the drive means. The rotation can in particular be advantageous when cleaning the container since, thereby, the introduced cleaning medium can be distributed better.

In a preferred further development of this embodiment, the lance part is arranged on a guide within the tube, wherein the guide is adapted to cause a rotation of the first lance part relative to the tube while the movement of the lance part along the longitudinal access of the tube. Thereby, the rotation of the lance can be achieved without additional drive means solely by the magnetic interaction of the first part and the drive part among each other and the movement of the lance part along the tube preset by the guide.

Furthermore, the device can be characterized in that the lance part is mounted on the guide by means of a lubricant-free bearing, in particular a four-point contact bearing. Undesired contaminations inside of the tube can thus be avoided.

The method according to the invention for introducing a medium into a container, for example a flexible pouch, comprises introducing the medium with a lance and is characterized in that the lance is indirectly magnetically moved into the container in order to introduce the medium.

In one embodiment, a sterilizing gas or a product is passed into the container via the lance.

It can be provided that the lance is moved along a longitudinal axis of a tube and is introduced into the container for passing the medium and is subsequently pulled out.

In a further development of this embodiment, it is provided that the lance is rotated during the passing. This embodiment of the method according to the invention allows, in particular when passing a cleaning medium, a reliable distribution of the medium inside the container.

FIG. 1 shows an apparatus 100 according to the invention that is adapted for passing a medium into a container, in particular a flexible container like a pouch 103. For this purpose, the apparatus 100 comprises a carousel 101 rotary mounted on a frame 102 with a plurality of treatment stations 110. While the embodiment as rotatable carousel (rotational axis R) is preferred, of course other embodiments can be thought of in which a linear apparatus is provided which does not rotate (linear filler or the like), and in which the containers are filled in separate stations.

The containers can, for example, be fixed on holders 112 in the apparatus 100 that are embodied in the form of clamps and attached to the sides of the container or pouch, respectively.

According to the invention, lances 111 can then be introduced into the containers 103 and a medium can be introduced via the same. This is schematically depicted by the position of the lance at different positions of the machine in relation to the rotational direction. The lance depicted in the middle is inserted into the container, the lances to the right of the middle are not yet inserted into the container and the lances to the left of the middle are pulled out of the containers again in this depiction. The lances 111 do not necessarily need to be inserted into the container 103. It is sufficient when the lances 111 and a corresponding outlet opening for the medium are positioned over the opening of the container 103.

It is provided according to the invention that the lances 111 can be moved into the direction of the containers or pouches 103, respectively, or can be moved away from the same, wherein the drive of the lances 111 takes place via an indirect magnetic drive means not yet depicted in detail in FIG. 1. Therein, "indirect" means, according to the invention, that a driving force of, for example, a motor or the like is not directly translated into a movement of the lance, but rather an indirect translation via at least one magnetic or electromagnetic interaction is provided such that a first part of the indirect magnetic drive means, that is joined with the lance (in the following also referred to as lance part) can be moved by means of a second part (drive part) of the magnetic drive means that, in turn, is driven. Herein, the lance part and the drive part of the indirect magnetic drive means are connected indirectly only via magnetic or electromagnetic interactions among each other. A mechanical connection or a mechanical contact of the first and the drive part is preferably not provided.

Figure 2:
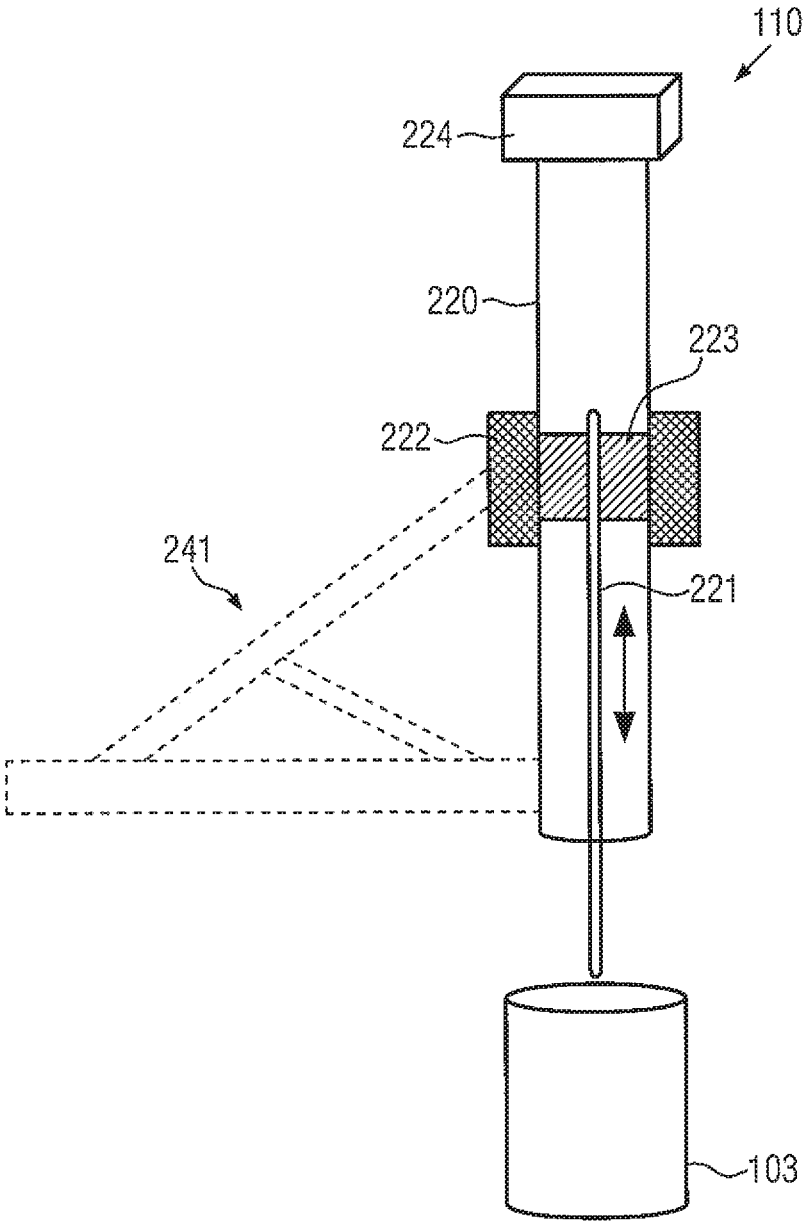
FIG. 2 is a schematic depiction of a treatment station.

For this, FIG. 2 shows a schematic view of a treatment station for illustrating the basic principle of the indirect magnetic drive means.

In FIG. 2 a treatment station 110 is depicted. It comprises a tube 220 that is depicted in cross section. The lance 221 extends through the inner space of the tube 220.

The lance 221 is joined with the lance part 223 of the indirect magnetic drive means, for example via screwing. The lance part 223 is movable inside the tube wherein at least a movement along the longitudinal axis, i.e. into the container and out of the container 103, is possible.

Furthermore, a medium supply 224 is depicted in which the medium to be introduced into the container is provided, in particular a gaseous cleaning or sterilizing medium. The lance as a component extends only into the area of the lance part 223 and ends at the upper end of the lance part. Here, the lance can be open to the top, i.e. in the direction of the medium supply, or a valve can be provided.

The space in tube 220 above the lance part can be filled at least partially with the medium to be filled into the container in case the lance is moved into the container such that the medium can be guided from this area through the lance into the container. For this purpose, opening the medium supply for letting in the medium in the area of the tube can be controlled depending on the position of the lance such that the medium is let in before the lance is inserted into the container.

The lance part 223 is indirectly magnetically coupled with the drive 222 of the indirect magnetic drive means. The drive part 222 is arranged outside the tube 220 and movable along the tube. The drive part 222 is moved by means of a drive 241 which is only shown dashed here. Due to the indirect magnetic coupling of the lance part 223 with the drive part 222, a movement of the drive part 222 is translated into a movement of the lance part 223.

Figure 3A:
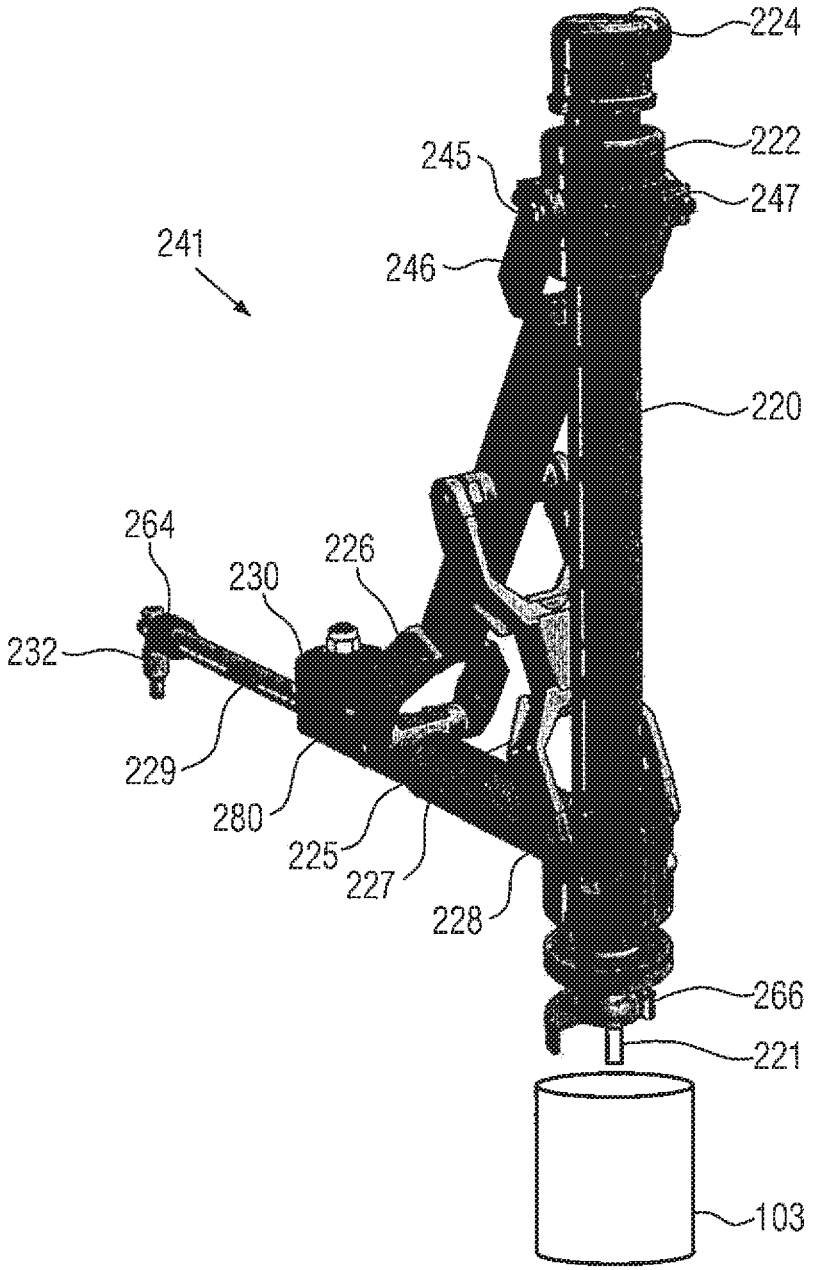
FIG. 3*a* is a perspective view of a treatment station according to one embodiment.

FIG. 3*a* shows a more detailed view of a preferred embodiment of the invention according to the principle of FIG. 2.

In this embodiment, the lance 221 is arranged together with the lance part 223 of the indirect magnetic drive means in the tube 220, for passing the medium into the container or pouch 103, respectively. The lance 221 is joined with the lance part 223 of the indirect magnetic drive means, wherein the lance part is movably mounted together with the lance 221 inside the tube 220.

At the lower end of the tube 220, an opening area 266 can be provided into which the opening of the container 103 can be inserted. The opening area 266 can also completely encompass the opening of the container 103 such that an isolation of the opening area of the container 103 from the surrounding atmosphere takes place. Thus, the filling of the medium can happen under preferably aseptic conditions.

Outside the tube 220, the drive part 222 of the indirect magnetic drive means is arranged. This part is also movable along the tube 220. For this, the drive part 222 can for example be mounted on a guide at the outer side of the tube 220. Due to the use of a corresponding guide, a correct upward and downward movement of the drive part along the tube can be ensured. Here, particularly low friction kinds of guides like, for example, a guide rail and a four-point contact bearing mounted therein can be used.

This, however, is not necessarily the case. The drive part 222 can also be arranged with a small distance, for example 0.5 mm or 1.0 mm or 2.0 mm from the outside of the tube 220 and can be movable along the longitudinal axis of the tube.

Here, the drive part 222 can, for example, partially or completely encompass the tube 220 as a hollow cylinder. In a corresponding embodiment, the drive part 222 completely extends around the depicted tube 220. The drive part can, however, also be comprised of single elements, for example cuboid-shaped, that are evenly distributed over the circumference of the tube 220 or can be arranged at specific, possibly also unevenly distributed positions.

In order to move the lance 221 inside the tube 220, it is provided that the drive part 222 is connected with a drive 241 that moves the drive part 222 along the longitudinal axis of the tube 220. The drive 241 depicted in FIG. 3*a* is, on its own, movable. The movement of the drive 241 can be translated into a movement of the drive part 222.

By the movement of the drive part 222, indirectly also the lance part is moved due to the magnetic or electromagnetic interaction between the lance part and the drive part, such that the lance 221 is moved into the container 103 or out of the container 103.

Here it is provided according to the embodiment depicted in FIG. 3*a*, that the drive part 222 is connected with an arm 226 of the drive 241. The arm can be connected via a movable connection with the drive part 222 or be hinged at the same, respectively.

For this purpose, it can be provided that the arm 226, at least in the area in which it is hinged at the drive part 222, is embodied as a double rocker 246. This way, it can clutch with two sides at the drive part 222. On each side, corresponding bearings 245 can be provided which connect the area of the double rocker 246 with the drive part 222. The connection with the drive part 222 can, here, for example happen indirectly via the sleeve 247 in which also the bearing 245 can be arranged. This form of the connection of the arm 226 with the drive part 222 is particularly stable and prevents potential misalignments during the movement of the drive part.

The arm 226 can additionally be connected with a guiding arm 227, wherein the guiding arm 227 is hinged at a point 228. The guiding arm 227 is rotatably mounted around the point 228. Also, the guiding arm 227 can be embodied as double rocker at both the hinge point at arm 226 and hinge point 228. The hinge point 228 can, for example, be arranged at the tube 220. Also, in the hinge point 228, a corresponding bearing for rotatably mounting the guiding arm 227 can be provided. A movement of the arm 226 can, thus, be stabilized and/or guided by the guiding arm 227.

The guiding arm 227 can be connected with the arm 226 either in a further hinge point or can be movably mounted along a guide provided in the arm 226. The hinging of the guiding arm 227 in point 228 defines a certain scope for the arm 226.

Further, it is provided in the embodiment according to FIG. 3*a* that the arm 226 is arranged on a carriage 280 that is movably mounted along a support pole 229. It can also be provided that the arm 226 is embodied together with the carriage 280 as a double rocker in the area of the connection. This connection provides for high stability.

Figure 4A:
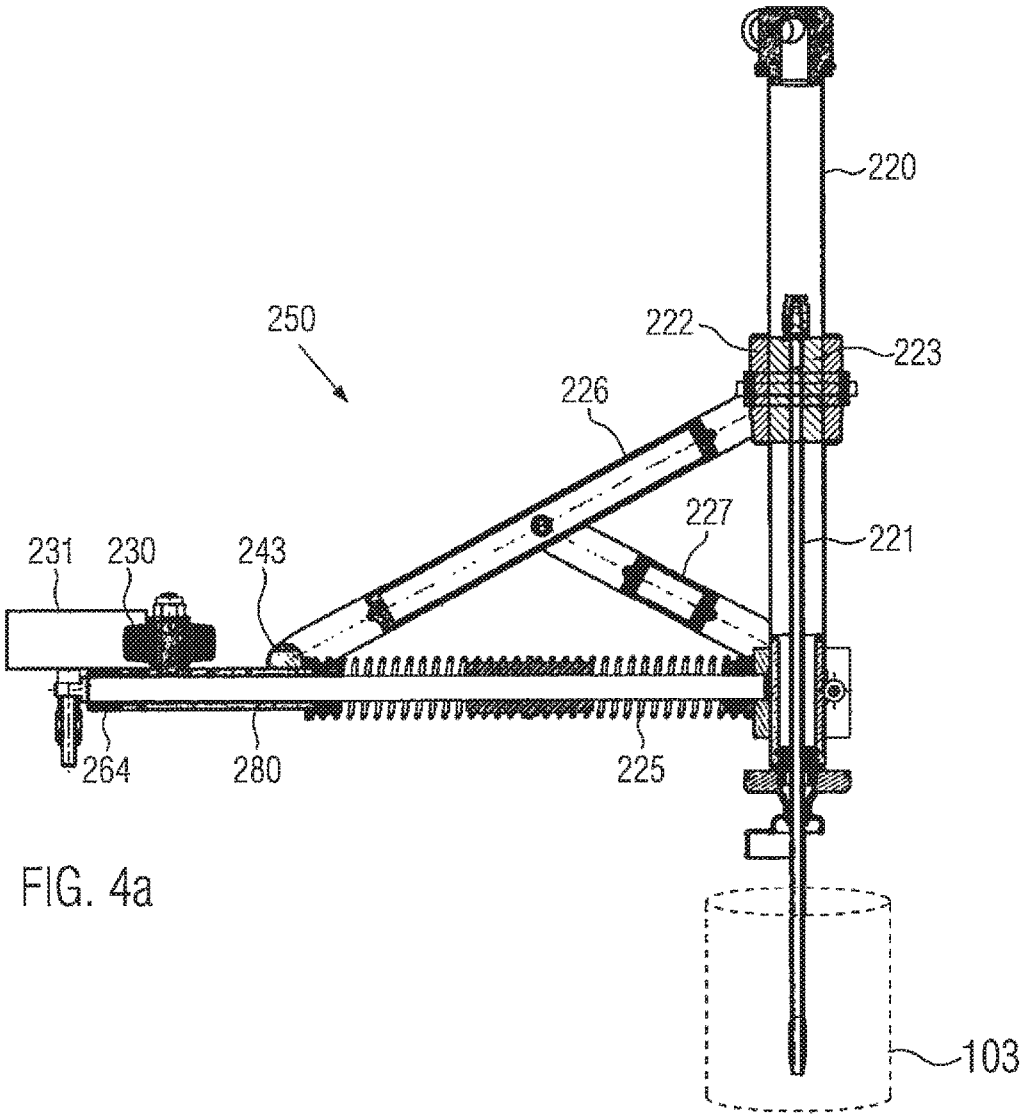
FIG. 4*a* is a side view of the treatment station with a lance moved into a container.

The support pole (support arm) 229 can be connected with the tube 220 and the complete treatment station can be fixed to the carousel. For this purpose, for example a screwing 232 can be provided. The fixing can additionally be provided by further means for fastening. The arm 226 can be arranged on the carriage 280 for example by means of a spherical joint like it is also depicted in FIG. 4*a* with reference sign 243. On the carriage 280, further cam roll 230 can be arranged.

The cam roll can, for example, be rotatably mounted on a carrier or pin. This pin can be rigidly connected with the carriage 280. The movement of the carriage along the pole can be limited in at least one direction by means of stop 264.

This cam roll can revolve along a control cam that is stationary arranged with respect to the carousel. In order to ensure for the contact of the cam roll 230 with the control cam, a spring element 225 can be connected with the carriage, wherein the spring element 225 can hold by tension the carriage and thus the cam roll 230 against the corresponding control cam. The spring element 225 can be arranged around the support pole 229. A possible embodiment of the control cam is depicted in the schematic top view according to FIG. 4*e*.

The use of the stop 264 can be used in an advantageous manner here in order to specify the maximum penetration depth of the lance into the container. Since the spring element 225 hold by tension the carriage in a position in which the lance is inserted into the container, wherein the spring element 225 presses the carriage in the direction of the stop 264, the movement of the carriage 280 can be limited at a specific position by the choice of the dimensions of the stop 264 in the direction of the movement of the carriage 280, such that a further moving of the carriage beyond this position (i.e. beyond the stop) is made impossible, whereby a further movement of the lance into the container can be prevented. Consequently, the maximum penetration depth of the lance into the container can be specified also independent from the control cam. The control cam can thus comprise a gap in an area in which the lance is moved into the container for passing the medium or can be distant further away from the carriage 280 or the cam roll 230, respectively, than the stop 264, such that the carriage together with the cam roll runs against the stop.

While the spring element 225 is connected, on the one side, with the carriage 280, it can be provided that the other side of the spring element 225 is either connected with the support pole 229 or with the tube 220.

Figure 4B:
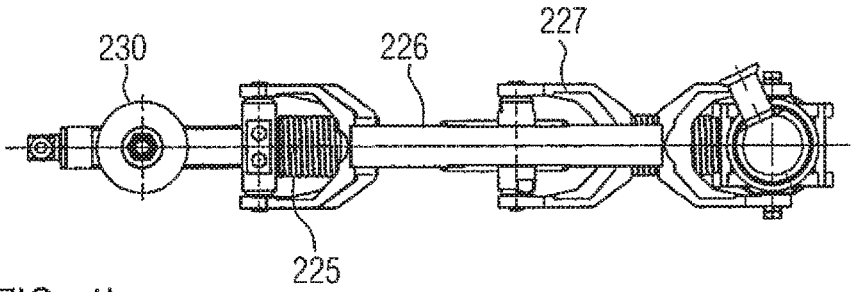
FIG. 4*b* is a top view of the treatment station of FIG. 4*a;*
Figure 4C:
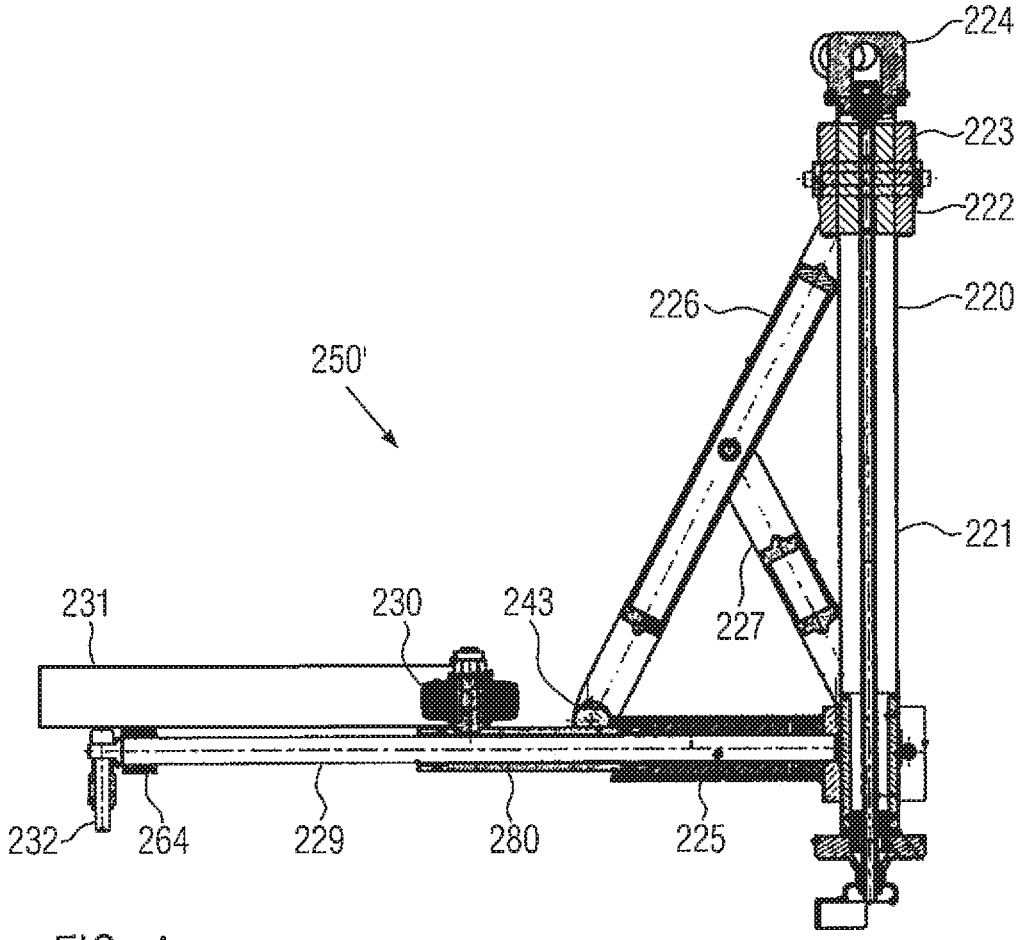
FIG. 4*c* is a side view of the treatment station with a lance pulled out from a container.
Figure 4D:
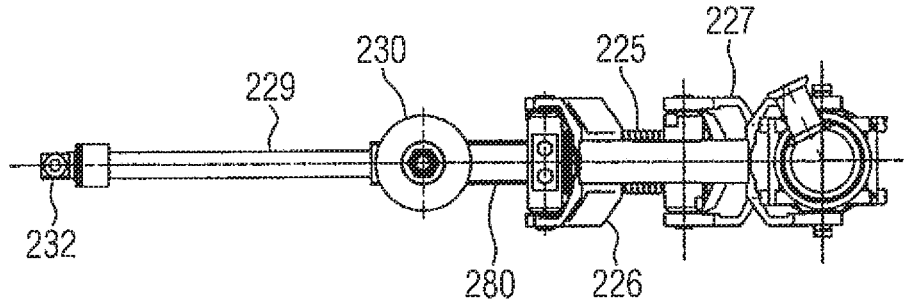
FIG. 4*d* is a top view of the treatment station of FIG. 4*c;*
Figure 4E:
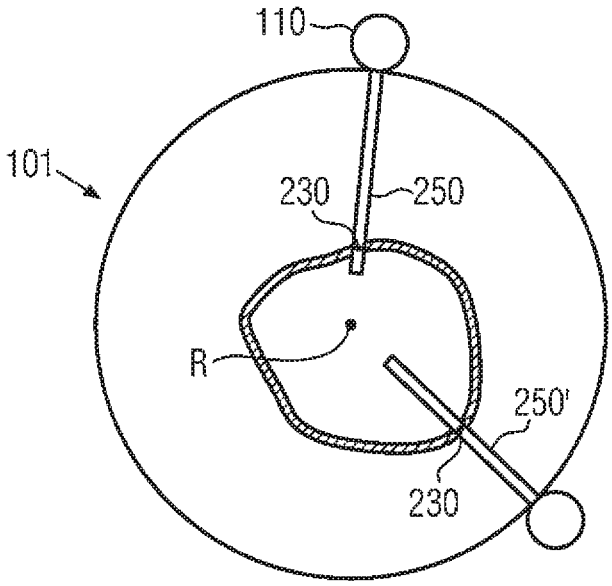
FIG. 4*e* is a schematic depiction of the position of the treatment stations of FIG. 4*a* and FIG. 4*c* in relation to a control cam.

Due to a suitable choice of the control cam, that can be arranged, for example, around the rotational axis R or the carousel depicted in FIGS. 1 and 4*e*, the movement profile of the drive part 222 and, thus, the movement profile of the lance 221, can be pre-set without requiring complicated control means.

In order to avoid jerky movements of the lance 221, it is particularly advantageous if the control cam 231 has a shape that can be at least piece-wisely described by mathematical functions that are continuous in each point. It is particularly preferred if the functions describing the control cam 231 are also continuous with their first derivation.

Furthermore, a medium supply 224 can be associated with the tube 220. In the medium supply, the medium to be inserted, particularly a sterilizing gas, can be stored. The medium can fill the space within the tube until the lance part and can flow into the lance through an opening of the lance at the upper side of the lance part that faces the medium supply, by, for example, applying a higher pressure to the medium in the tube compared to the pressure of the environment.

Figure 3B:
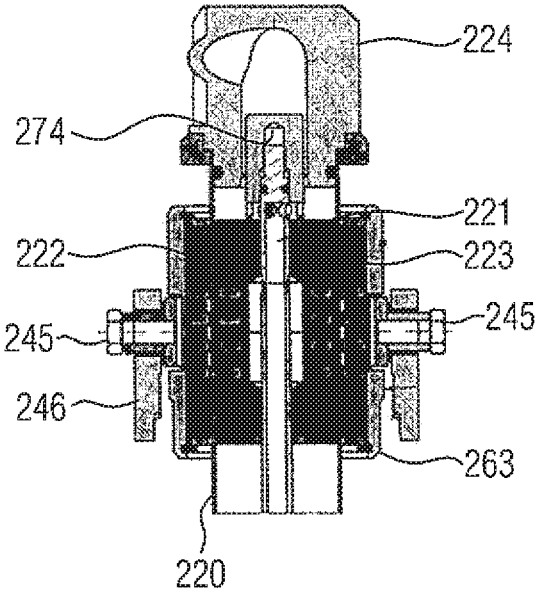
FIG. 3*b* is an enlarged view of the head area of the treatment station of FIG. 3*a;*

FIG. 3*b* shows the head area of the treatment station according to the embodiment of FIG. 3*a* with the medium supply 224 in a detailed depiction, wherein the drive part 222 and the lance part 223 together with the lance 221 are also displaced into this area of the tube 220. In the medium supply 224 a hollow space, in particular a pipe line, can be provided through which the medium that is to be filled into the lance 221 can be channeled. The channeling of the medium can, for example, happen through the depicted valve 274.

In one embodiment, it can be provided that, during each upward movement of the lance, the medium that is to be passed into the container is channeled through the valve into the lance by opening the valve 274 in the area of the medium supply 224. If the lance is again moved away from the medium supply 224 into the direction of the container, the valve can be closed and the supply of medium via the medium supply 224 can be interrupted. According to this embodiment, the lance would thus transport the medium that is to be introduced into the container from the medium supply 224 to the container, wherein the lance 221 would not be permanently connected with the medium supply.

Furthermore, FIG. 3*b* shows a more detailed view of the drive part 222 and the lance part 223. The connection described with reference to FIG. 3*a* between the drive, in particular the arm 226, and the drive part 222 is depicted here in more detail. When the arm 226 is embodied as double rocker, each part of the double rocker engages on the left side or the right side, respectively, at the drive part 222. Here, it is connected via, for example, screwings or bolts 245 with the drive part 222. The mounting of the double rocker at the drive part 222 is preferably moveable, in particular rotatable. Thus, it can be ensured that, during movement of the arm 226, the drive part 222 can be moved along the tube.

Additionally, it is depicted in FIG. 3*b* that the drive part 222 is surrounded by a hull 263. In particular, the drive part can be encapsulated on all sides facing away from the tube 220 by the hull. Contaminations of the drive part can thus be prevented. Furthermore, the hull can be comprised of diamagnetic material in order to localize the magnetic fields of the drive part 222 and the lance part 223 preferably in the area of the tube.

The embodiment of the indirect magnetic drive part according to FIGS. 3*a* and 3*b* is not mandatory. It can also be provided that the drive part 222 is moveable along the tube 220 along the direction of arrow depicted via a servo drive. It can also be provided that the drive part 222 together with the lance part 223 forms a linear drive, wherein the drive part 222 can be embodied as a plurality of electromagnets that are stationary mounted outside of the tube 220. By actuating the separate electromagnets, a movement of the lance part 223 together with the lance 221 can be realized.

For each treatment station 110, a separate control unit can be provided in this case, that actuates the electromagnets such that, in each treatment station 110, a possibly individual movement profile of the lance part 223 together with the lance 221 can be achieved. This is particularly of advantage in case different containers that, for example, vary in their size, are treated in the apparatus according to FIG. 1 during one treatment cycle.

The lance part is comprised of or comprises a permanent magnet. The drive part can also comprise a permanent magnet, but can also be embodied as electromagnet or comprise the same.

In principle, the medium used can, for example, be a gaseous medium like hydrogen peroxide ($H_2O_2$) for sterilizing the inner area of the container 103 or it can be the product to be filled into the container 103. However, also other gaseous media can be used for sterilizing. Furthermore, an inflating of the pouch by means of introduced air can happen. Alternatively, the apparatus can also be used to fill a product to be filled into the container/pouch.

Particularly when using a gaseous medium, it can be provided that the tube 220 extends at least around the opening area of the container 103 arranged in the treatment station 110. Furthermore, it can be provided that, by a corresponding outlet opening of the lance or by an air or medium supply within the tube 220, an at least slight overpressure is applied in the area of the opening of the container 103 compared to the pressure outside the treatment station, such that no air from the outside enters into the opening area of the container 103. Thereby, the introducing of the medium via the lance 221 can happen at preferably aseptic conditions. This embodiment can advantageously be used to realize filling of the product into the container 103 by a corresponding treatment station 110 under preferably aseptic conditions.

FIG. 4*a* shows a treatment station corresponding to the embodiment according to FIGS. 3*a* and 3*b* with a lance moved into the container. FIG. 4*b* is a top view onto the treatment station of FIG. 4*a*. Furthermore, FIG. 4*c* shows the treatment station with a lance moved out of the container and FIG. 4*d* shows a corresponding top view onto the treatment station. In FIG. 4*e*, a schematic top view of the carousel with a control cam is depicted for illustrating the movement sequence.

In the arrangement 250 in FIG. 4*a*, the lance 221 is moved into the container 103 and introduces or has introduced the medium. The carriage 280 is, in this state, situated close to the stop 264 wherein the cam roll is either in contact with the control cam 231 or is not in contact with the same and is pressed against the control cam 231 or the stop by the spring element. This is synonymous to the distance of the control cam 231 to the rotational axis R of the carousel according to FIG. 1 being smallest (also refer to FIG. 4*e*).

After the medium has been passed into the container 103, the lance is now piecewise or continuously pulled out from the container 103. In order that the lance 221 can be backed out from the container 103, the lance part 223 must be moved away from the container 103 along the tube 220. Correspondingly, also the drive part 222 has to be moved away from the container. In order to achieve this, the arm 226 must be moved towards the tube 220. This is achieved by the cam roll being moved away from the rotational axis R of the carousel by the control cam against the tension of the spring element. In the situation 250' depicted FIG. 4*c*, the distance of the control cam 231 to the rotational axis R of the carousel is thus bigger than the distance in the situation depicted in FIG. 4*a*.

As is recognizable from FIG. 4*c*, the carriage was likewise moved away from the stop 264 (along the pole), such that the arm 226 was rotated around the hinge 243 (for example a spherical joint) and was displaced into the depicted erected position. Correspondingly, a movement of the drive part 222 took place such that the lance part is indirectly driven and the lance is moved away from the container.

In FIG. 4*c*, the lance 221 arrived at the endpoint of the movement furthest outside the container 103.

The corresponding distances of the control cam to the rotational axis in position 250 according to FIGS. 4*a* and 250' according to FIG. 4*c* are schematically depicted in FIG. 4*e*.

During movement of the lance 221 out of the container 103, in particular when using this apparatus for passing a cleaning medium like hydrogen peroxide via an outlet opening in the lance 221 at the lower end (the end that is also moved into the container 103), bringing out of a medium can be continued such that also the opening area of the container does not come into contact initially with the normal surrounding air.

Figure 5A:
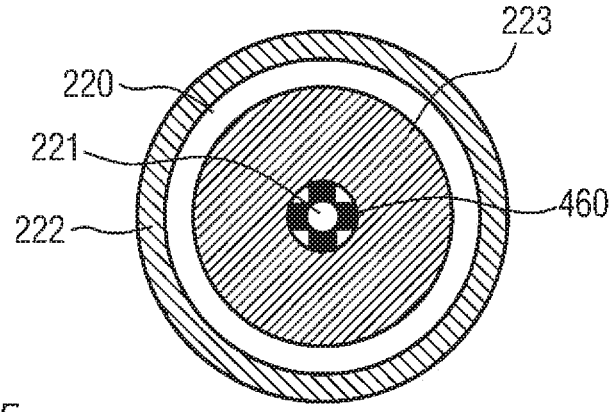
FIG. 5*a* is a schematic top view of a tube of a treatment station according to one embodiment in which the lance is rotatable.
Figure 5B:
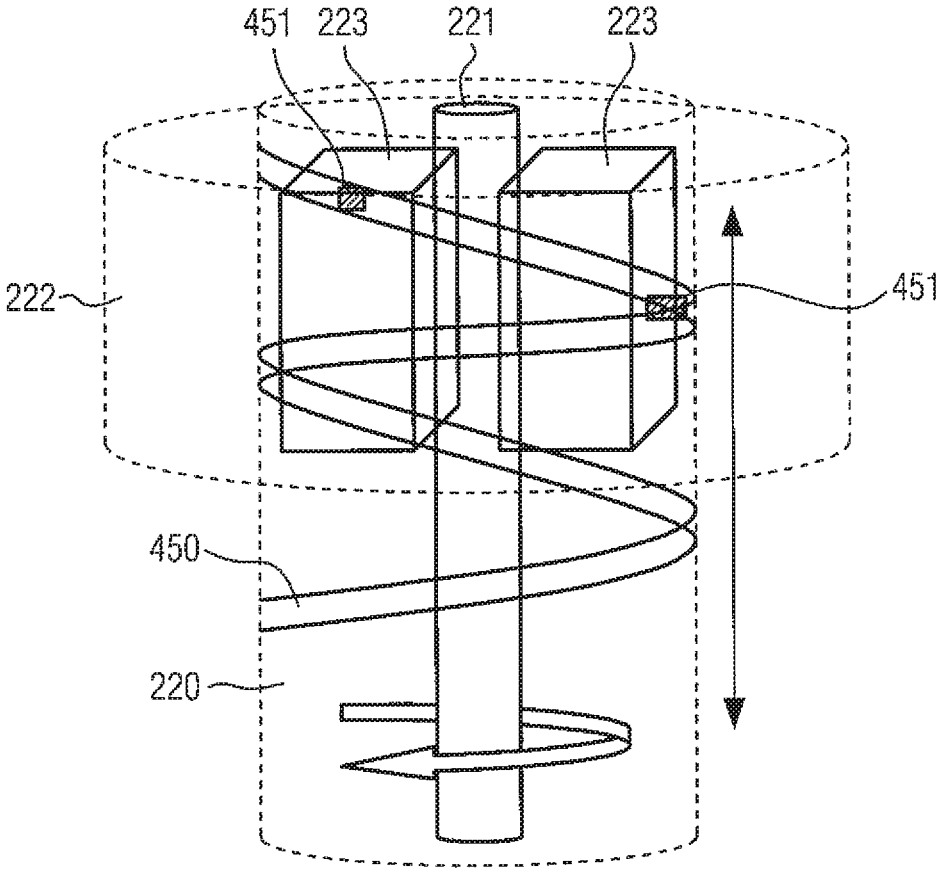
FIG. 5*b* is a perspective view of the embodiment with a rotational drive for the lance.

FIGS. 5*a* and 5*b* show a further embodiment of the indirect magnetic drive means. For this, a cross-section through the tube as it is depicted schematically in FIG. 2 is provided in FIG. 5*a*. While in the embodiment according to FIG. 2 and the embodiment as it was described in FIGS. 3*a* and 3*b*, the tube 220 can have an arbitrary cross-section, that can, for example, be cornered or round, a round inner cross-section of the tube 220 is envisaged in the embodiment according to FIGS. 5*a* and 5*b*. Inside the tube, the lance part 223 of the indirect magnetic drive means for the lance 221 is arranged. The lance part 223 is depicted here as hollow cylinder that is fixedly joined with the lance 221 via connecting elements 460. The lance part 223 is not necessarily provided as hollow cylinder and can also be assembled from separate elements. For example, one or more cuboid-shaped elements can be provided that are arranged in the tube 220, along a guide. These are then each joined with the lance 221 via connecting elements 460. According to the embodiment in FIGS. 5*a* and 5*b*, the drive part 222 of the indirect magnetic drive element in FIG. 5*a* is also arranged as a hollow cylinder completely surrounding the tube 220. In the embodiment according to FIGS. 5*a* and 5*b*, it is necessary that the drive part 222 completely surrounds the tube 220. Admittedly, the outer cross-section of the tube 220 and the inner cross-section of the drive part 222 do not need to be round as depicted, but in this way, cants can be avoided.

FIG. 5*b* shows a schematic view of the inner area of the tube 220, wherein the tube 220 and the drive part 222 of the indirect magnetic drive means are here depicted only dashed and translucent in order to not risk the clearness. In FIG. 5*b*, the lance part 223 is depicted schematically by means of two cuboids. In the embodiment according to FIG. 5*b*, the lance part 223 is connected with a guide 450 being arranged inside the tube 220 via guiding elements 451. This can be provided as helix. By providing this guide and guiding the lance part 223 by means of the guiding elements 451 during a movement along the shown double arrow, a rotation of the lance 221 can be ensured. Due to the upward and downward movement of the drive part 222 outside the tube 220, a rotational movement of the lance part 223 corresponding to the form of the guide 450 can be superimposed to the upward and downward movement of the lance part 223 inside the tube 220.

Here, the guide 450 does not need to be provided as a helix but can, for example, also comprise linear sections and differently strong curved sections. This embodiment is in particular advantageous during a cleaning of the containers with a cleaning medium since the lance and in particular one or the outlet openings that are moved into the container can be rotated. If, for example, a plurality of outlet openings are arranged at the circumference of the lance, these can treat the inner surface of the container under different exit angles of the medium due to the rotation. With this, it can be ensured that the cleaning is preferably complete and effective since in particular for flexible pouches, for example, folds can be treated under different angles with the cleaning medium.

Since the rotation of the lance or the outlet openings for the medium, respectively, may only be desired inside the container, it can be provided that during the movement of the lance towards the container, the guide 450 comprises a linear section that is in parallel to the longitudinal axis of the tube 220 and comprises a shape corresponding to a screw thread (helix) only in the area in which the lance part 223 is to be rotated in order to also allow for a rotation of the lance while this is at least partially introduced into the container.

The guiding elements 451 depicted in FIG. 5*b* are preferably lubricant-free in order to prevent a contamination of the opening area and in particular the inner area of the container. For this, for example, four-point ball bearings can be used.

While the above embodiments are all described by utilization of a tube in which the lance and the lance part are arranged, the tube can also be omitted and, instead of the tube, only a guide for the lance part of the indirect magnetic drive means can be provided such that by moving the drive part with the help of one of the above described drives, an indirect drive of the lance part and the lance joined thereto can be realized.

Since the lance part together with the lance are only indirectly connected with the drive part of the indirect magnetic drive means, there is the risk that that the lance part together with the lance falls down due to the gravity acting upon it. In order to prevent this, the lance part can be held by tension by a spring element that, for example, is arranged inside the tube in analogy to the drive part. For this, also a flexible tube can serve that is connected with the reservoir and the lance and through which the medium to be passed into the container can be guided. Furthermore, the field intensity of the field prevailing between the first and the drive part can be selected such that the gravity acting upon the lance and the lance part is balanced and those elements are "hovering".

While there have been shown and described fundamental novel features of the invention as applied to the preferred and exemplary embodiments thereof, it will be understood that omissions and substitutions and changes in the form and details of the disclosed invention may be made by those skilled in the art without departing from the spirit of the invention. Moreover, as is readily apparent, numerous modifications and changes may readily occur to those skilled in the art. For example, any feature(s) in one or more embodiments may be applicable and combined with one or more other embodiments. Hence, it is not desired to limit the invention to the exact construction and operation shown and described and, accordingly, all suitable modification equivalents may be resorted to falling within the scope of the invention as claimed. It is the intention, therefore, to be limited only as indicated by the scope of the claims appended hereto.

What is claimed is:

1. An apparatus for passing a medium into a container, comprising a rotatable carousel and one or more treatment stations with a movable lance that can be inserted into the container, wherein an indirect magnetic drive means for moving the lance is provided, wherein a lance part of the magnetic drive means is joined with the lance and a drive part of the magnetic drive means is indirectly magnetically coupled with the lance part, wherein the lance is rotated by means of the magnetic drive means.

2. The apparatus according to claim 1, wherein the container comprises a flexible pouch.

3. The apparatus according to claim 1, wherein the lance and the lance part are arranged in a tube and are movable along the longitudinal axis of the tube, and the drive part is arranged outside the tube and is movable along the longitudinal axis of the tube.

4. The apparatus according to claim 3, wherein the drive part is connected with a drive by which the drive part can be moved along the tube.

5. The apparatus according to claim 4, wherein the drive comprises an arm that is movably connected with the drive part, wherein the arm is arranged movably along a control cam via a cam roll and movement of the cam roll along the control cam is transferred into a movement of the drive part along the tube.

6. The apparatus according to claim 5, wherein the control cam is arranged stationary with respect to the carousel.

7. The apparatus according to claim 5, wherein the arm is connected with a spring element that holds the arm in an initial position by tension.

8. The apparatus according to claim 1, wherein the drive part comprises a magnet engaging the lance part.

9. The apparatus according to claim 1, wherein the lance part is arranged at one end of the lance and a nozzle is arranged at the other end of the lance, wherein the medium can be led from a reservoir through the lance to the nozzle.

10. The apparatus according to claim 1, wherein the medium is a sterilizing gas or a product that is to be filled into the container.

11. The apparatus according to claim 5, wherein the control cam encloses the axis of rotation of the carousel and a shape of the control cam is continuous.

12. The apparatus according to claim 4, wherein the magnetic drive means comprises a linear drive or a servo drive.

13. The apparatus according to claim 1, wherein the lance part is mounted in a guide arranged in the tube, wherein the guide is adapted to cause a rotation of the lance part relative to the tube while the lance part is moved along the longitudinal axis of the tube.

14. The apparatus according to claim 13, wherein the lance part is mounted in the guide by means of a lubricant-free bearing.

15. The apparatus according to claim 14, wherein the bearing is a four-point ball bearing.

16. A method for passing a medium into a container, comprising passing the medium into the container via a lance, wherein the lance is indirectly magnetically moved into the container in order to introduce the medium, wherein the apparatus according to claim 1 is used for passing the medium into the container.

17. The method according to claim 16, wherein a sterilizing gas or a product is passed into the container via the lance.

18. The method according to claim 16, wherein the lance is moved along a longitudinal axis of a tube and introduced into the container for passing the medium and, subsequently, is pulled out.

19. The method according to claim 18, wherein the lance is rotated while moving into the container and out of the container.

* * * * *